United States Patent [19]

Bravo

[11] 4,428,395

[45] * Jan. 31, 1984

[54] LOCK APPARATUS FOR STORAGE TANKS

[76] Inventor: Sergio M. Bravo, 1823 N. Hill Dr., South Pasadena, Calif. 91030

[ * ] Notice: The portion of the term of this patent subsequent to Aug. 24, 1999 has been disclaimed.

[21] Appl. No.: 229,225

[22] Filed: Jan. 28, 1981

Related U.S. Application Data

[63] Continuation-in-part of Ser. No. 129,509, Mar. 11, 1980, Pat. No. 4,345,617.

[51] Int. Cl.[3] ..... F16K 35/06

[52] U.S. Cl. ..... 137/385; 70/180; 137/364; 137/382; 137/588; 141/52; 141/290; 220/85 VR; 220/86 AT; 251/98; 251/306; 251/308

[58] Field of Search ..... 70/177, 180; 137/363, 137/364, 382, 385, 588; 141/52, 290; 220/85 P, 85 V, 85 VR, 85 VS, 86 AT; 251/98, 99, 306, 308

[56] References Cited

U.S. PATENT DOCUMENTS

| | | | |
|---|---|---|---|
| 1,099,077 | 6/1914 | Wray | 137/385 X |
| 1,248,926 | 12/1917 | Schantz | 251/306 X |
| 1,387,971 | 8/1921 | Farmer | 251/292 |
| 2,335,899 | 12/1943 | Arvintz | 70/180 X |
| 2,802,492 | 8/1957 | Gosselin | 141/52 X |
| 3,111,300 | 11/1963 | Boone | 251/306 |
| 3,200,836 | 8/1965 | Trefil et al. | 137/385 |
| 3,311,128 | 3/1967 | Taylor | 251/98 X |
| 3,329,394 | 7/1967 | Overbaugh | 251/99 |
| 3,675,677 | 7/1972 | Scaramucci | 251/306 X |
| 4,345,617 | 8/1982 | Bravo | 137/385 |

*Primary Examiner*—Gerald A. Michalsky

*Attorney, Agent, or Firm*—Nilsson, Robbins, Dalgarn, Berliner, Carson & Wurst

[57] ABSTRACT

A lock apparatus for attachment to the top of an input pipe communicating with a storage tank includes an open-ended cylindrical housing for mounting to the top of the input pipe, a valve assembly pivotally mounted in the housing with a valve activating axle protruding through an orifice in the housing, and a locking mechanism. The valve assembly includes at least one valve plate with a seal member provided around the edge of the valve plate for sealing the space between the edge of the valve plate and the cylindrical housing when the valve assembly is closed. The locking mechanism includes a latch pivotally attached to the protruding end of the axle, a lock flange attached to the outside of the housing and a tamper prevention flange above and in linear alignment with the axle and the latch to prevent unauthorized tampering with the axle and attached latch. The latch may be coupled to the lock flange and locked to maintain the valve in the closed position across the interior of the housing.

12 Claims, 8 Drawing Figures

LOCK APPARATUS FOR STORAGE TANKS

CROSS REFERENCE TO RELATED APPLICATION

This is a continuation-in-part application of Ser. No. 129,509 filed Mar. 11, 1980, entitled LOCK APPARATUS FOR FLUID STORAGE TANKS, now U.S. Pat. No. 4,345,617.

BACKGROUND OF THE INVENTION

The present invention relates to a lock apparatus and in particular to a lock apparatus mountable to a pipe communicating with a storage tank to prevent unauthorized withdrawals from the storage tank and undesired leakage of contaminants into the storage tank.

With the advent of increasing gasoline prices, a serious problem of theft has arisen whereby individuals insert a hose into a storage tank at a gasoline station through the fuel input pipe communicating with an underground storage tank. The fuel is then pumped from the underground storage tank thereby effecting a theft of the fuel.

Various devices have been devised to prevent such unauthorized withdrawals. However, these devices have generally been in the form of a lock-on cap mechanism which is inserted over the top of the communicating pipe. For example, one such cap mechanism incorporates a lock flange which extends upwardly from the top surface of the cap and a latch which is pivotally mounted to the side of the cap. The latch is then pivotal between a locked and an unlocked position with the lock flange being positioned in such a way that when the latch is pivoted to the locked position a padlock can be inserted into a hole in the lock flange to prevent pivotal movement of the latch to the unlocked position.

Although this and other similar cap type lock devices prevent access to the underground storage tank through the pipe, it has been found that such caps can be easily removed by exerting pressure with a crowbar or the like against either the latch or the lock flange to break either the latch or the lock flange. Consequently, there is a need for a more secure locking mechanism to prevent thefts of gasoline or other flowable substance from storage tanks.

The present invention provides such an improved lock mechanism by providing an open ended cylindrical housing for attachment to the top of the input pipe. The cylindrical housing includes a radially mounted valve mechanism which is pivotal in the interior of the housing between an opened and a closed position. The valve mechanism includes a shaft or axle which has one end extending through an orifice in the side of the cylindrical housing. A latch is then pivotally attached to the protruding end of the axle with a lock flange being affixed to the outside surface of the housing whereby the latch and the lock flange are aligned for interconnecting to one another when the valve is in the closed position. A suitable padlock or other locking device can then be attached to the lock flange to maintain the coupled relationship of the lock flange and the latch. A suitable tamper prevention flange is provided to extend outwardly from the housing immediately above the protruding end of the axle. The tamper prevention flange is positioned to protect the axle and the latch and prevent the insertion of a prying device to effect a breaking of the latch or axle.

The valve mechanism includes a sandwiched plate assembly including a first rigid plate member having a circumferential edge positioned in spaced relationship with the housing, a second rigid plate member having a circumferential edge likewise positioned in spaced relationship with the housing and a generally disc like resilient member sandwiched between the first and second rigid plates and extending beyond the circumferential edges of the first and second rigid plates for contacting and sealing the space between the inside surface of the housing and the circumferential edges of the first and second rigid plates.

The portion of the resilient member protruding beyond the edge of the rigid plates comprise a seal which additionally prevents a foreign substance such as water from passing through the pipe and into the storage tank. Thus, the valve mechanism serves the purpose of not only preventing a foreign object from being inserted into the storage tank through the pipe for the purpose of making an unauthorized withdrawal from the storage tank but also preventing foreign substances from being introduced into the storage tank through the pipe.

SUMMARY OF THE INVENTION

A lock apparatus for attachment to a pipe defining a pipe passageway communicating with a storage tank, for preventing the insertion of a foreign object or substance into the storage tank through the pipe passageway, includes a housing, a valve assembly pivotally mounted in the housing for being selectively pivoted between an obstructing position and a non-obstructing position in the housing passageway, and a locking means for selectively positioning and holding the valve assembly at least in the obstructing position. More specifically, the housing has a housing passageway therethrough and is adapted for attachment to the pipe with the housing passageway in coaxial alignment with the pipe passageway. In addition, the housing is provided with a transverse orifice through one of its sides. The valve assembly preferably includes a shaft which is pivotally mounted to the housing in transverse relationship to the housing passageway with one end of the shaft extending through the transverse orifice of the housing. The valve assembly further comprises a closure means which is fixed to the shaft in the housing passageway for being pivoted by the shaft between the opened and closed positions. The closure means has a circumferential edge which is spaced from the interior surface of the housing. A seal means is then attached to extend from the circumferential edge of the closure means for contacting and sealing the space between the housing and the circumferential edge of the closure means when the valve assembly is pivoted to the closed or obstructing position in the housing passageway. Finally, the locking means is provided for releasably coupling the one end of the shaft to the housing to thereby selectively position and hold the valve assembly at least in the obstructing position in the housing passageway.

In one embodiment, the closure means may comprise a first rigid plate having a circumferential edge spaced from the housing, a second rigid plate having a circumferential edge also spaced from the housing, and a generally disc like resilient member sandwiched between the first and second rigid plates and extending beyond the circumferential edges of the first and second rigid plates to thereby seal the space between the housing and the aforementioned edges when the closure means is in the obstructing position. Means are provided for attaching the sandwiched first and second rigid plates and the resilient member to the shaft in the housing passageway in a manner whereby the sandwich assembly will not pivot or rotate on the shaft.

The locking means may comprise a latch member which is pivotally attached to the one end of the shaft, a lock flange fixed to the housing externally of the housing passageway and a tamper prevention flange which is fixed to the external surface of the housing in linear alignment with the transverse orifice and the lock flange. The lock flange is thus preferably positioned adjacent to the transverse orifice for selectively engaging the latch member and interconnecting the latch member to the lock flange.

The latch member in the preferred embodiment includes a shaft engaging end having a shroud for covering one end of the shaft on three sides thereof and a lock flange engagement end from which a handle flange extends.

The tamper prevention flange preferably comprises a generally L-shaped member which is positioned adjacent two sides of the transverse orifice to thereby prevent access to the one end of the shaft on three sides thereof.

In one embodiment of the invention, the lock apparatus may also provide a positioning flange fixed to and extending from the surface of the cylindrical housing whereby the latch member and the positioning flange may be interconnected together when the axle is pivoted to position the valve in the opened non-obstructing position. The valve can thus be maintained in the open position when, for example, fuel is being inserted into the storage tank.

In the preferred embodiment, an "O" ring or other seal device may be inserted between the axle and the housing in the transverse orifice for preventing fluid leakage through the transverse orifice.

BRIEF DESCRIPTION OF THE DRAWINGS

A complete understanding of the present invention and of the above and other objects and advantages thereof may be gained from a consideration of the following description of the preferred embodiments taken in conjunction with the accompanying drawings in which.

DETAILED DESCRIPTION

Figure 1:
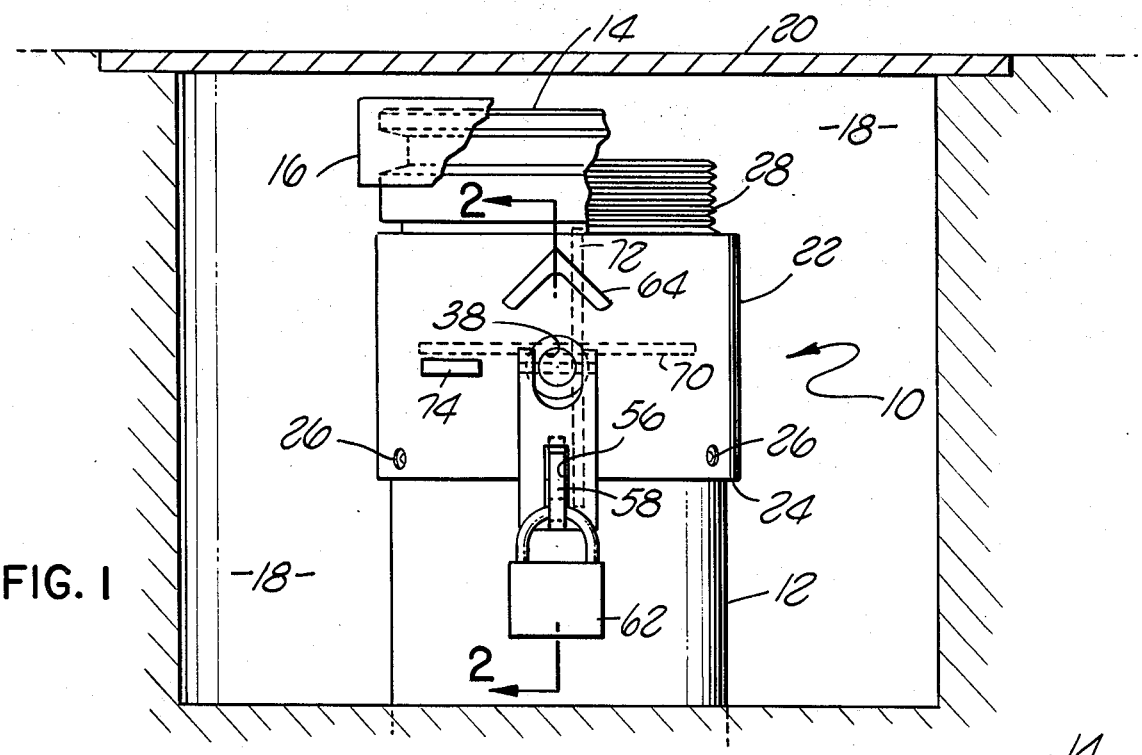
FIG. 1 is a side plan view of a lock apparatus in accordance with the invention in position on top of pipe communicating with a storage tank.

Referring first to FIG. 1, the present invention comprises a lock apparatus 10 which is fixed by appropriate means such as an inside thread, to the top of a pipe 12 having an outside thread. The pipe communicates with, for example, an underground storage tank (not shown). An appropriate adapter member 14 may then be fixed, such as by a threaded interconnection, to the top of the lock apparatus 10 with a suitable cap 16 being removably positioned on top of the adapter member 14. The entire assembly including the lock apparatus 10, the adapter 14 and the cap 16 are positioned underground in a ground cavity 18 which may be enclosed by a cover plate 20.

When it is desired to insert a fluid into the underground storage tank through the pipe 12, the cover plate 20 and then the cap 16 are removed. A hose with an appropriate nozzle interconnection arrangement is then attached and held by the adapter member 14. The lock apparatus 10 is then opened and the fluid, such as gasoline or the like, is pumped from a tank truck, for example, to the underground storage tank.

Figure 2:
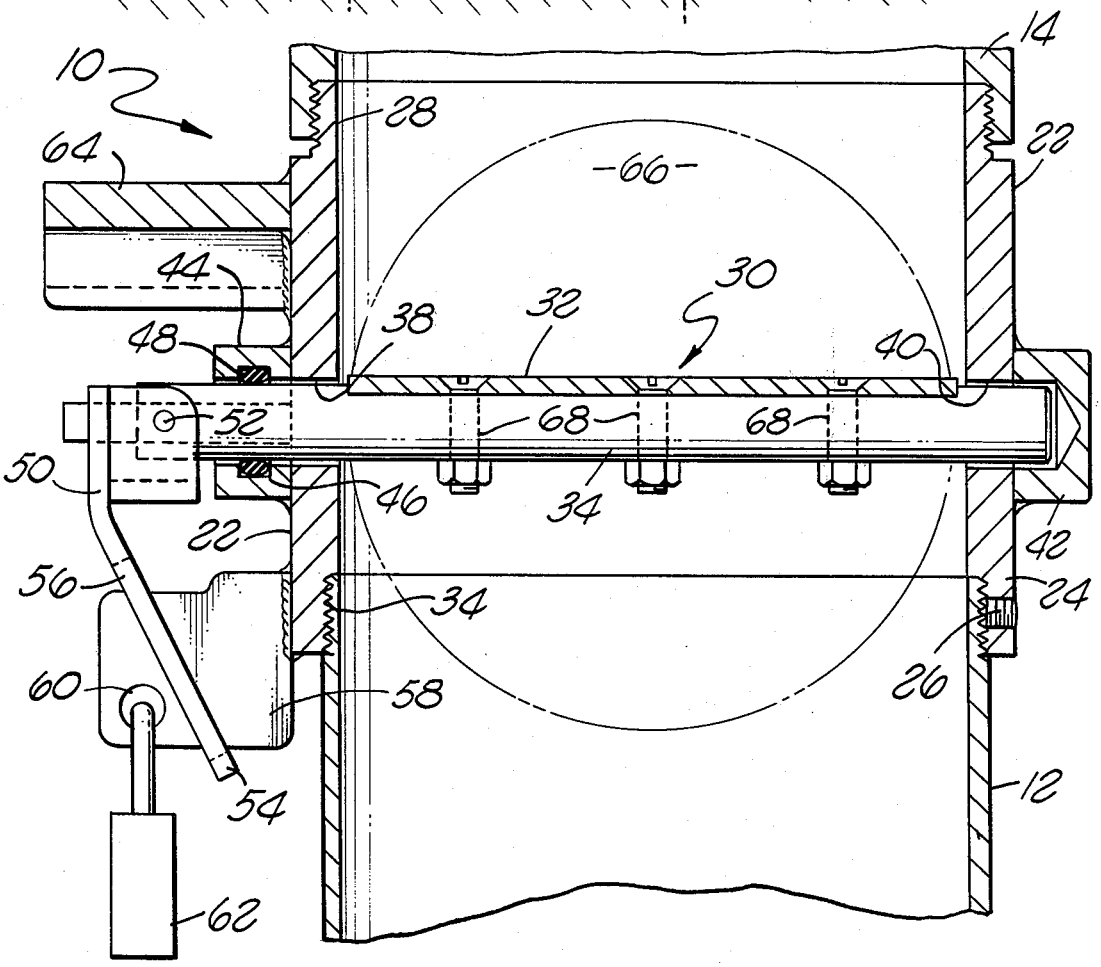
FIG. 2 is a side cross-sectional plan view of the lock apparatus in accordance with the invention.

Referring now more specifically to FIG. 1 in connection with FIG. 2, the lock apparatus 10 in accordance with the invention includes a cylindrical housing 22 having a bottom part 24 which is attached to the top of the pipe 12. In one embodiment, the bottom part 24 of the housing 22 may have an interior thread which is screwed onto the top of an exterior thread on the top of the pipe 12. A plurality of set screws 26 may be provided to immovably interconnect the lock apparatus 10 to the top of the pipe 12 to prevent the lock apparatus 10 from being simply unscrewed from the top of the pipe 12.

The lock apparatus 10 also has a top part 28 which preferably has an external thread to which the adapter 14, having an internal thread, can be attached by simply screwing the adapter 14 onto the top part 28 of the lock apparatus 10.

A butterfly valve apparatus 30 is then pivotally attached in the interior of the lock apparatus 10. The butterfly valve apparatus comprises a plate 32 attached to an axle 34 by screws or other suitable means 68. The axle 34 and plate 32 are pivotally attached to extend through the radial orifice 38 in the side of the cylindrical housing 22. The axle 34 may be supported by the housing 22 entirely at the orifice 38. Alternatively, the axle 32 may be pivotally interconnected across a diameter of the cylindrical housing 22 between an orifice 40 on one side and the orifice 38 on the opposite side. A cap member 42 may then be provided on the outside of the cylindrical housing 22 to cover and seal the orifice 40.

A cylindrical flange 44 may be attached by welding or the like to the outside of the housing 22 surrounding the orifice 38. The cylindrical flange 44 may be provided with a cylindrical seal retaining groove 46 disposed about the interior cylindrical surface of the cylindrical flange 44. A suitable radial orifice seal such as an "O" ring seal 48 may be disposed in the seal retention groove 46 around the axle 34 to prevent fluid entering the storage tank through the cylindrical housing 22 from leaking out through the orifice 38. Of course it will be appreciated that leakage through the orifice 40 is prvented because the cap 42 seals that orifice without the need for seals.

In summary, therefore, the axle 34 is mounted to the cylindrical housing 22 by providing one end of the axle to extend into the orifice 40 to be supported by the cylindrical housing 22 and to extend through the orifice 38 and the cylindrical flange 44 opposite the orifice 40.

A latch member 50 is pivotally attached by a pin 52 to the end of the axle 34 extending through the orifice 38 and the cylindrical flange 44. The latch member 50 is provided with a downwardly extending inwardly bent flange portion 54 having a latch orifice 56 disposed therethrough. In the preferred embodiment the latch 56 is a slot along the length of the downwardly extending flange portion 52 of the latch member 50.

A lock flange 58 is disposed by welding or the like to extend from the cylindrical housing 22. The lock flange 58 is positioned vertically below the orifice 38 and is welded to extend from the bottom part 34 of the cylindrical housing 22. The lock flange 58 is provided with an orifice 60 therethrough for receiving a padlock 62.

Finally, a tamper prevention flange 64 is attached by welding or the like to extend from the external surface of the cylindrical housing 22 adjacent the top part 28 thereof. The tamper prevention flange 64 is also preferably disposed in vertical alignment with the cylindrical flange 44 and the lock flange 58 and is of a sufficient length to prevent a tool such as a crowbar or the like from being inserted against the end of the axle 34 thereby preventing any possibility that the latch member 50 could be pried or broken off of the end of the axle 34.

In operation, the butterfly valve apparatus 30 is pivotal between a closed position and an open position. The butterfly plate 32 is preferably the same shape as the interior cross-section of the axial cavity 66 through the cylindrical housing 22 in order to prevent the unauthorized insertion of a tube, hose or other object into the fuel storage tank through the pipe 12. Thus, if the axial cavity 66 is circular, then the butterfly valve plate 32 will also be circular but will, of course, be of a slightly smaller diameter to allow pivotal rotation of the plate in the interior of the axial cavity 66 without coming in contact with the sides of the cylindrical housing 22. The butterfly plate 32 is attached to the axle at a location selected so that the butterfly plate 32 extends across the axial cavity 66 in the closed position when the latch orifice 56 of the latch member 50 is aligned with the lock flange 58. Thus, when the lock flange 58 extends through the latch orifice 56, the plate 32 will be in the closed position preventing any object from being inserted through the axial cavity 66 into the underground storage tank.

When it is desired to open the butterfly valve apparatus 30, the latch member 50 is merely rotated outwardly about the pin 52 to disconnect the latch member 50 from the lock flange 58. The latch member 50 may then be rotated 90 degrees so that the plate is in a vertical, opened position rather than the previously discussed horizontal closed position.

A positioning flange 74 may also be provided to extend from the side of the cylindrical housing 22 at a location disposed at an angle approximately 90 degrees from the lock flange 58 about the axle 34, to maintain the plate 32 in a vertical, opened position, to allow fluid to be inserted through the pipe 12 into the storage tank.

Figure 3:
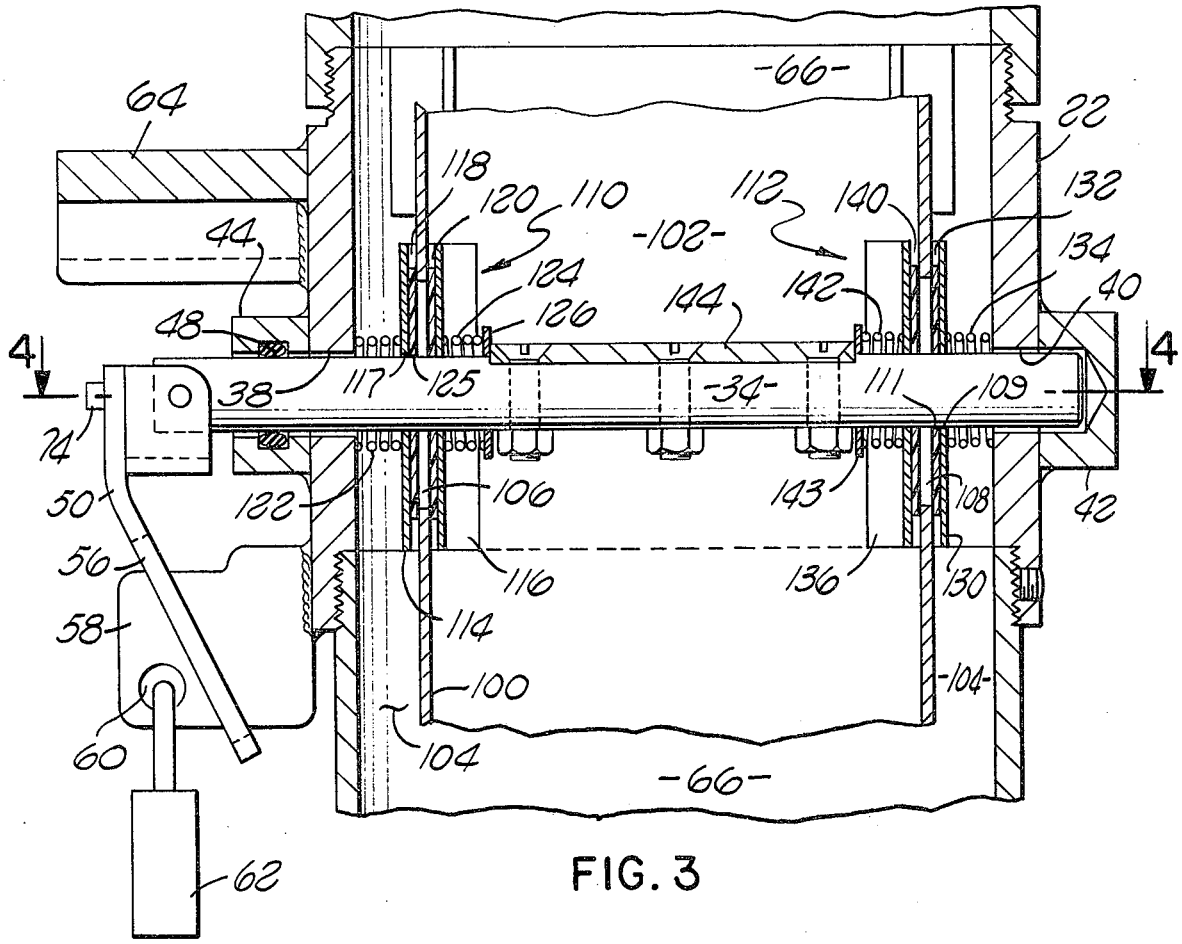
FIG. 3 is a side cross-sectional plan view of a second embodiment of a lock apparatus in accordance with the invention.
Figure 4:
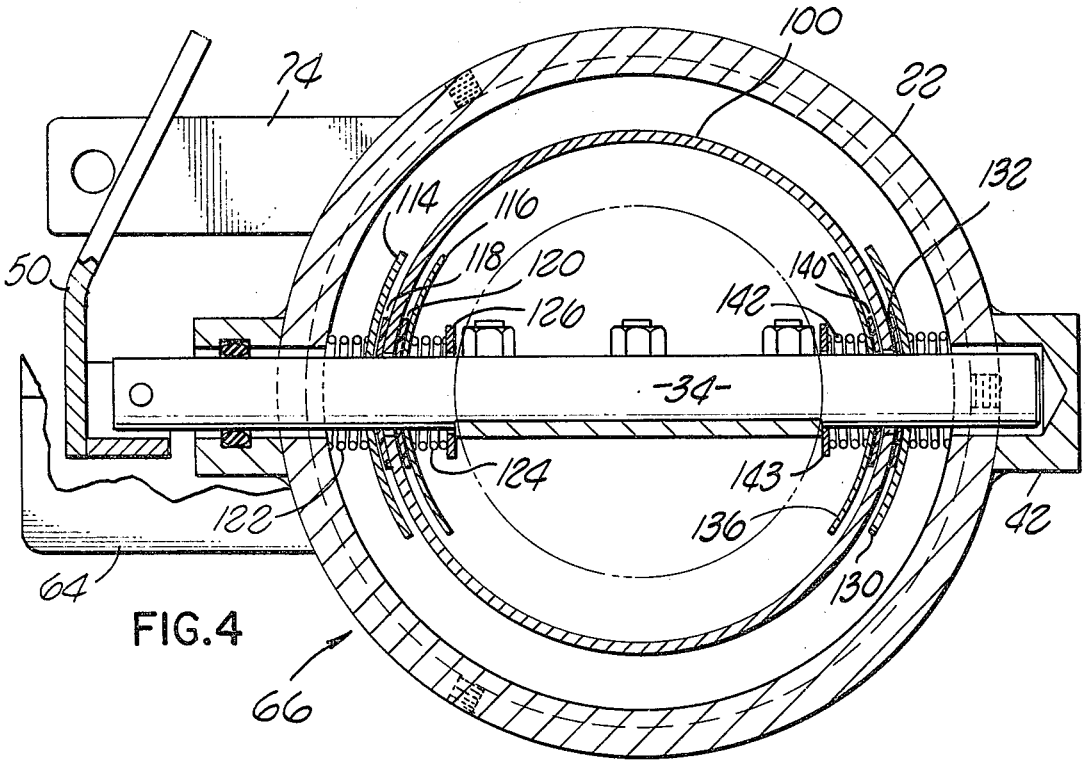
FIG. 4 is a top cross-sectional plan view of the second embodiment illustrated in FIG. 3.

Referring now to FIGS. 3 and 4, a second embodiment of the present invention is illustrated wherein a cylindrical tube 100 is centrally disposed to extend through the central housing 22 thus bifurcating the axial cavity 66 into a central passageway 102 extending through the cylindrical tube and a circumferential passageway 104 extending downwardly through the cylindrical housing 22 between the cylindrical tube 100 and the cylindrical housing 22.

The purpose of this bifurcated axial cavity arrangement is to provide a means of vapor recovery without the need for having two pipes interconnected to the storage tank. Thus, the gasoline or other fluid is inserted into the storage tank through the central passageway 102 and the fumes, which must necessarily be displaced, pass out through the circumferential passageway 104 surrounding the central passageway 102. Such an arrangement is well known in accordance with one type of vapor recovery system.

In order to provide a lock apparatus in accordance with the invention in this arrangement, it is necessary that the axle extend not only through the orifice 38 in the housing 22, but also extend through orifices in the cylindrical tube 100. Furthermore, in most arrangements in which a cylindrical tube 100 is incorporated, the cylindrical tube 100 is provided to move upwardly and downwardly to a small extent, thus requiring that the cylindrical tube 10 include at least one slot orifice in one side and aligned with the radial orifice 38 in the housing. More specifically, the cylindrical tube 100 includes a first slot orifice 106 and optionally includes a second slot orifice 108 located radially opposite to the first slot orifice 106. The width of the slot orifices 106 and 108 are approximately the same as the width of the axle 34.

A first seal apparatus 110 is then disposed around the axle 34 to cover the first slot orifice 106 so that fluid passing through the central passageway 102 does not leak through the first slot orifice and into the circumferential passageway 104. Similarly, a second seal apparatus 112 is disposed about the axle 34 to cover the second slot orifice 108 to likewise prevent the passage of fluid from the central passageway 102 through the second slot orifice 108 into the circumferential passageway 104.

The seal apparatus 110 may comprise a first semicircular cross-sectioned plate 114 having a cylindrical axle-receiving orifice 117 therethrough, positioned adjacent the outside of the cylindrical tube 100 covering the first slot orifice 106. A second plate is similarly disposed adjacent the inside surface of the cylindrical tube 100 also covering the first slot orifice 106. A first resilient seal member 118, having an axle receiving orifice 125 therethrough and which may be made out of rubber or any other suitable sealing material, is disposed between the first place 114 and the outside surface of the cylindrical tube 100 and a second resilient seal member 120 is positioned between the second plate 116 and the inside surface of the cylindrical tube 100 to also cover the first slot orifice 106. A spring 122 or other suitable pressing means is disposed between the inside wall of the cylindrical housing 22 and the first plate 114 to press the first plate 114 against the cylindrical tube 100 with the seal 118 compressed therebetween.

A second spring 124 is likewise disposed between a suitable washer-like flange 126 which is fixed to the axle 34 so that the spring 124 exerts a force against the second plate 116 to thereby press the plate 116 against the cylindrical tube 100 with the seal 120 compressed therebetween.

Of course, it will be appreciated that while two plates and two seals are preferred, a single plate and seal may be sufficient to provide adequate sealing in many instances and hence the second plate and second seal may be eliminated.

In a similar manner the second seal apparatus 112 consists of a third plate 130 being an axle receiving orifice 108, and a third resilient seal member 132, also having an axle receiving orifice 111 therethrough, which are disposed to cover the second slot orifice 108. A spring 134 is disposed to press against the plate 130 and thereby hold the seal 132 in place against the cylindrical tube 100 to cover the slot 108.

A fourth plate 136 may also be disposed adjacent the inside surface of the cylindrical tube 100 with a resilient seal member 140 disposed between the plate 136 and the inside surface of the cylindrical tube 100. A suitable spring 142 may then be positioned between a circumferential washer-like flange 143 which is attached about the periphery of the axle 34. The spring thus presses the plate 136 and hence the seal 140 against the inside of the cylindrical tube 100 covering the slot 108 to thereby prevent fluid from passing from the central passageway 102 to the circumferential passageway 104.

In accordance with the invention, a butterfly plate 144 is attached to a flattened region of the axle 34 to extend substantially across the interior of the cylindrical tube 100 to thereby close the central passageway 102 and prevent the insertion of an object through the central passageway 102 into the storage tank.

While specific features of these embodiments of the invention have been described, it will be appreciated that various other arrangements are possible. For example, the axle 34 may be supported entirely by the cylindrical flange and central housing 22 at the first orifice 38 without the need for a orifice 40 or a cap 42. Similarly, the second slot 108 may be eliminated if the axle 34 is provided to terminate at a central location in the cylindrical tube 100.

Although the above-described embodiments are particularly useful in an application where the locking apparatus is attached to the top of a pipe of an underground storage tank, it will be appreciated that the storage tank need not be underground and further that the storage tank need not store merely a fluid but may store any other flowable substance such as grain. In such an embodiment, it is of course preferable to increase the security of the lock mechanism to provide an enclosure apparatus about the housing so that the housing and hence the valve assembly is contained in a chamber defined by the enclosure apparatus. For example, a steel box like structure may be welded or otherwise attached to the end of the pipe communicating with the storage tank to define a chamber in which the valve mechanism in accordance with the invention is disposed. The enclosure apparatus, such as the steel box, is then opened on one end to provide access to the latch member. However, the enclosure assembly is only large enough to permit access to the latch member through an opening in the enclosure apparatus which is opposite or remote from the point at which the enclosure apparatus is attached to the end of the pipe. Thus, access to the latch member and the shaft is prevented except through the opening in the enclosure member and the tamper-free prevention flange in conjunction with the enclosure apparatus can more effectively prevent unauthorized tampering such as with a crow bar or other prying device.

Of course it will be appreciated that such an enclosure means is not essential. Nevertheless, in the embodiment where the storage tank is underground, the ground cavity into which the end of the pipe extends provides the enclosure apparatus.

Figure 5:
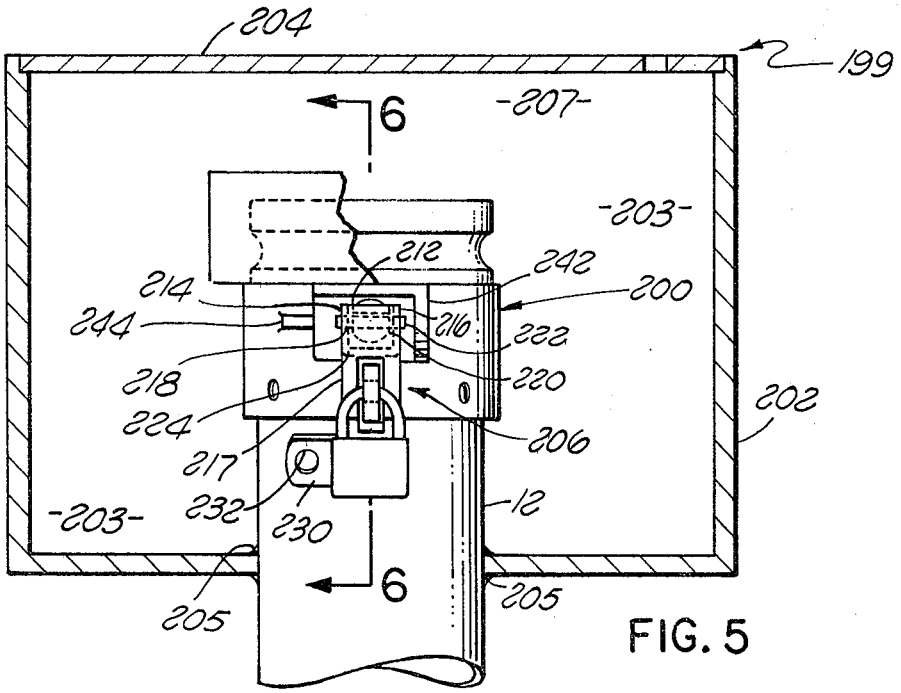
FIG. 5 is a side plan view of a lock apparatus in accordance with the invention in position on top of a pipe communicating with a storage tank and including a L-shaped tamper prevention flange and a handle flange.

Referring now to FIG. 5, a lock apparatus 199 in accordance with another embodiment of the invention, includes a lock housing 200 which is attached by any suitable means to the end of a pipe 12 communicating with a storage tank (not shown). The lock housing 200 and end of the pipe 12 to which the lock housing 200 is attached are preferably positioned in a chamber 203 defined by an enclosure means 202. The enclosure means 202 may, for example, comprise a steel box which is welded by weld 205 to the end of the pipe 12 or may be a concrete box into which the end of the pipe 12 extends. Of course, if such an enclosure means 202 is utilized, means must be provided to allow access to the lock housing 200. For example, an opening 207 may be provided opposite to the side through which the pipe 12 extends into the chamber 203 to allow access to a locking means 206 to be described hereafter. This opening 207 may or may not be provided with a removable cover 204. The chamber 203 should be sufficiently large to allow access from the direction of the opening 207 but should not be so large as to enable easy access to the locking means 206 from the sides or below a tamper prevention flange 242 to be described hereafter.

Figure 6:
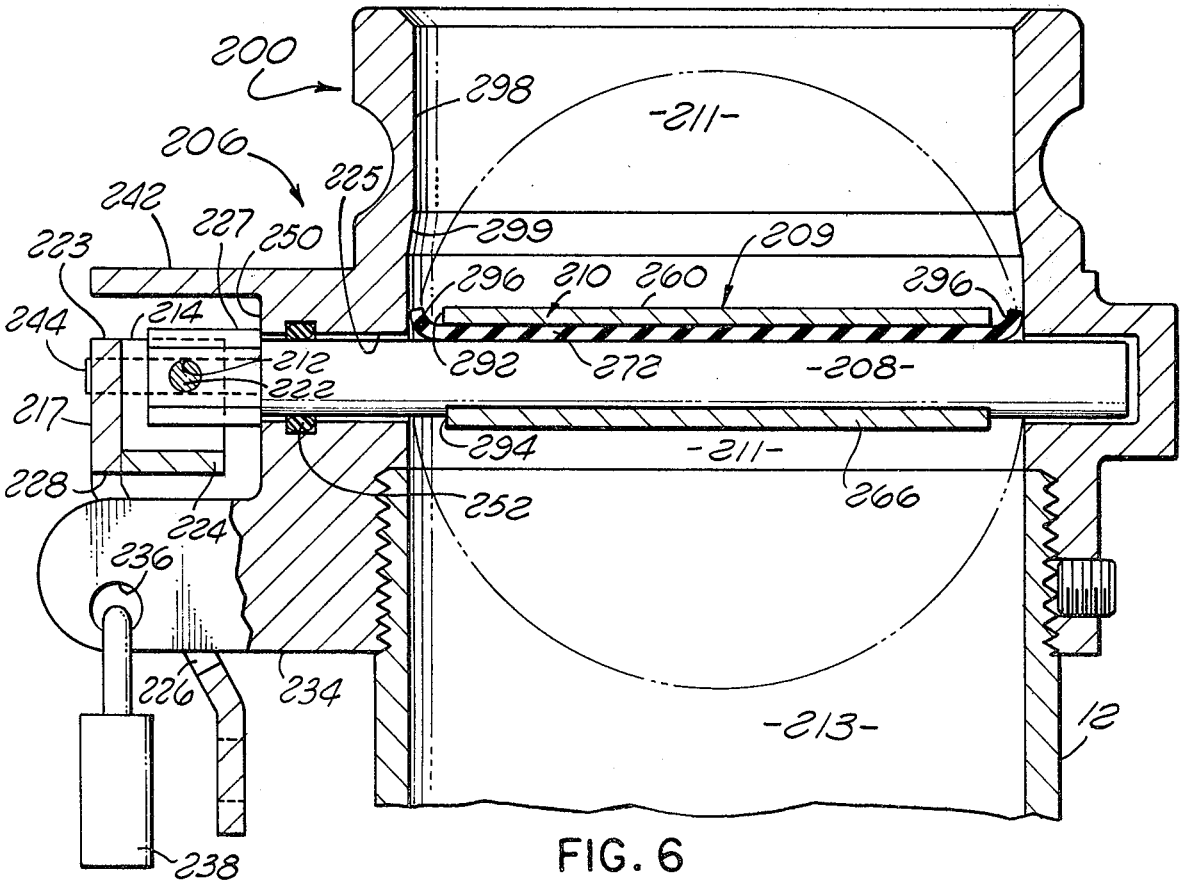
FIG. 6 is a side cross-sectional plan view of the lock apparatus in accordance with the embodiment of the invention shown in FIG. 5.

Referring now to FIGS. 5 and 6, the lock apparatus 199 includes the lock housing 200 attached to the end of the pipe 12. the locking housing 200 may be open ended, generally tubular pipe which defines a housing passageway 211 therethrough. The lock housing 200 is positioned on the pipe 12 so that the housing passageway 211 is in generally coaxial alignment with the pipe passageway 213 defined by the pipe 12.

The lock apparatus 199 also includes a valve assembly 209 pivotally mounted in the housing 200. The locking means 206 is provided for selectively pivoting the valve assembly 209 between an open, non-obstructing position (shown in phantom in FIG. 6) and a closed, obstructing position (shown in solid lines in FIG. 6) in the housing passageway 211 and further enabling the valve assembly 209 to be held and locked at least in the obstructing position.

The valve assembly 209 generally includes a latch member 217 attached to a shaft or axle 208 whereby the housing passageway 211 may be closed or opened by pivoting the shaft 208 and hence the closure assembly 210. The latch member 217 and the means by which it is immovably attached to the shaft 208 will be described hereafter.

The shaft 208 is pivotally mounted to the lock housing 200 with one end of the shaft 227 extending through a transverse orifice 225 through the side of the lock housing 200. In one embodiment, a boss 250 may be provided around the transverse orifice 225 with an "O" ring seal 252 positioned in the transverse orifice 225 between the boss 250 and the circumferential surface of the shaft 208 to thereby prevent leakage from the housing passageway 211 through the transverse orifice 225.

In the preferred embodiment, the locking means 206 includes a latch member 217 which is pivotally attached to the one of the shaft 227 extending through the transverse orifice 225. The locking means 206 also includes a lock flange 234 which is attached by welding or otherwise integrally formed with the lock housing 200, to extend radially from the housing 200 in vertical alignment below the transverse orifice 225 (that is, between the transverse orifice 225 and the storage tank). In the preferred embodiment, the lock flange 234 has a lock flange orifice 236 therethrough for receiving a suitable padlock 238.

The latch member 217 has a shaft engaging end 223 at one end thereof and a lock flange engagement end 226 at the other end thereof. An oppositely disposed pair of spaced flanges 214 and 216 are provided to extend from the shaft engaging end 223 in the direction of the shaft 208. Aligned orifices 218 and 220 extend through the flanges 214 and 216, respectively. In addition, a pin orifice 212 is provided through the one end 227 of the shaft. Finally, a pin 222 is provided to attach the latch member 217 to the one end of the shaft 227 by extending through the aligned orifices 218 and 220 and the pin orifice 212 in the shaft 208. The latch member 217 is thus pivotal about the pin 222.

To enable greater protection and hence greater security to the shaft 208 at the point of connection between the latch member 217 and the shaft 208, an additional flange 224 may be interconnected between the edges of the flanges 214 and 216 nearest the lock flange engagement end 226 of the latch member 217. The flanges 214, 216 and 224 will thus form a cup-like structure in which the end of the shaft 227 is positioned.

The lock flange engagement end 226 of the latch member 217 is provided with a latch orifice 228 therethrough. In addition, a handle flange 230 is provided to extend from the latch flange engagement end 226. In the preferred embodiment the handle flange 230 has a handle orifice 232 therethrough so that the latch member 217 can be grasped by an angled or hooked end rod to first pivot the latch member 217 outwardly to disengage the latch member 217 from the lock flange 234 and thereafter rotate the latch member 217 to thereby rotate the shaft 208 to open the housing passageway 211.

As previously discussed, a positioning flange 244 may also be provided to extend through the latch orifice 228 to hold the valve assembly 209 in the opened or non-obstructing position.

The locking means 206 finally comprises the tamper prevention flange 242 which is generally a L-shaped flange 242 which is positioned to be adjacent to two sides of the traverse orifice 225 with the L-shaped flange generally facing in the direction of the lock flange 234 and the positioning flange 224.

Figure 7:
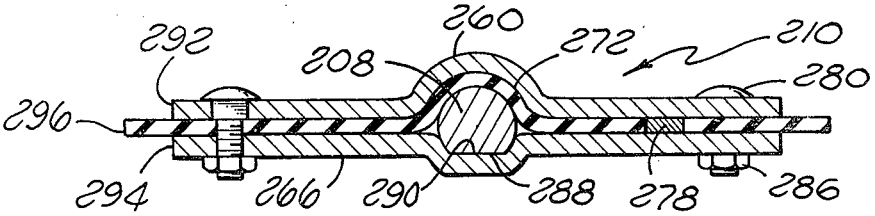
FIG. 7 is a cross-sectional plan view of a sandwiched valve assembly in accordance with the embodiment shown in FIG. 5.
Figure 8:
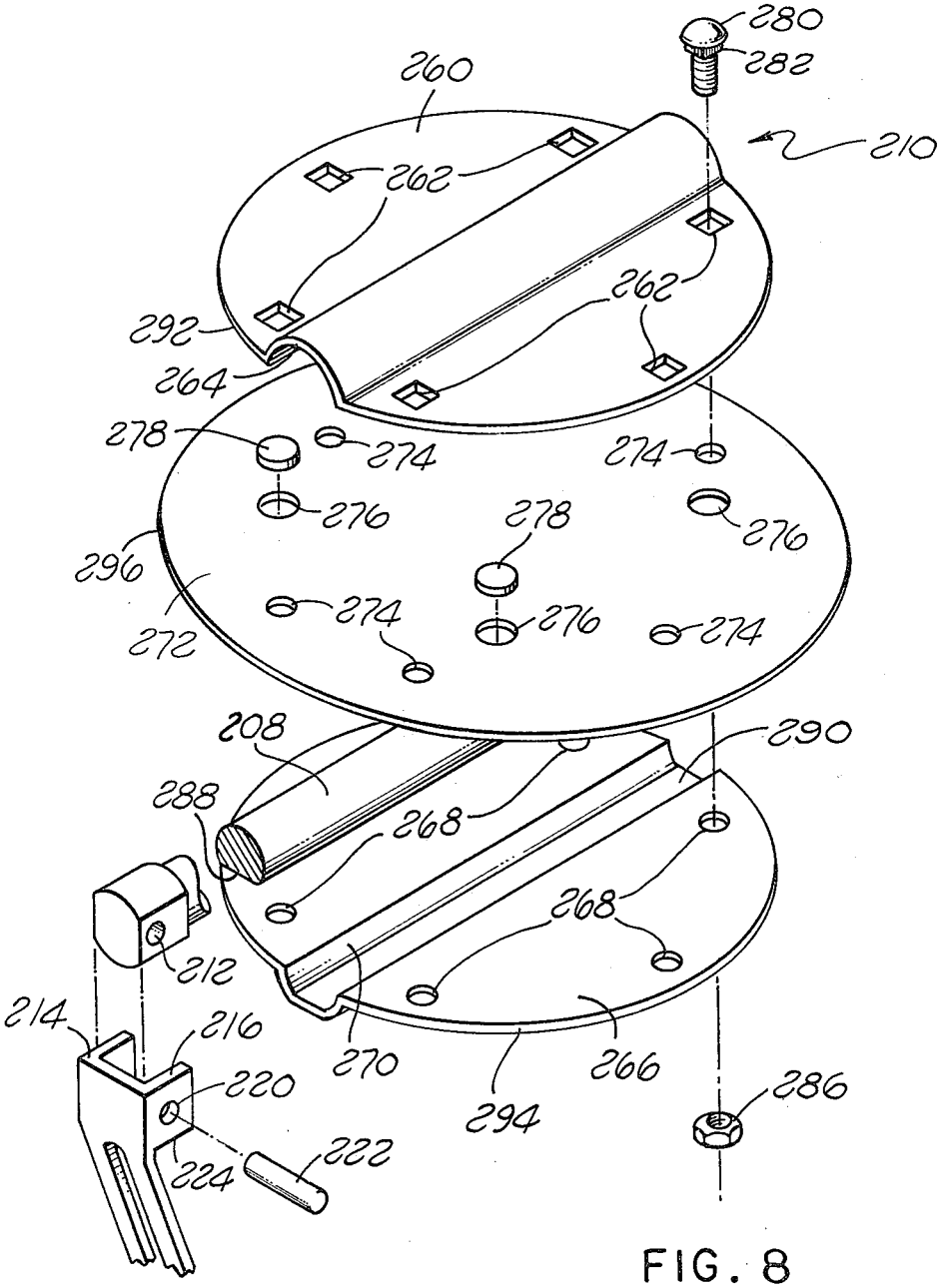
FIG. 8 is an exploded prospective view of a valve assembly in accordance with the embodiment of the invention shown in FIG. 7.

Turning now to FIGS. 6, 7 and 8, the closure means 210 which is immovably fixed to the shaft 208 in the housing passageway 211, preferably includes a facing plate 260, a back plate 266 and a resilient sealing disc 272 which is positioned in a sandwich configuration between the facing plate 260 and the back plate 266. The facing plate 260, which will be nearest the access or insertion end of the lock apparatus 199 when the closure means 210 is in the obstructing or locked position, is a generally flat plate which is made out of a rigid material such as steel and preferably has a plurality of square bolt holes 262 therethrough. A central shaft receiving furrow 264 is also provided to extend across a diameter of the face plate 260. The face plate 260 is preferably circular to match the circular cross-section of the housing passageway 211. Of course, it will be appreciated that the facing plate 260 and the back plate 266, which is also preferably circular, will each have a diameter somewhat smaller than the inside diameter of the housing passageway 211 so that the edges of the facing plate 260 and the back plate 266 will be freely pivotal with the shaft 208 without coming in contact with the inside surface 298 of the housing 200.

The back plate 266 likewise has a plurality of bolt receiving holes 268 which may be square or round and a central shaft receiving furrow 270. The back plate 266 is likewise made out of a rigid material such as steel.

The resilient sealing disc 272 is preferably made of rubber or other resilient material and is generally elliptically shaped and has a plurality of bolt holes 274 and a plurality of spacer holes 276 therethrough. An appropriate rigid spacer such as the spacer 278 is then positioned in each of the spacer holes 276 to maintain the facing plate 260 and the back plate 266 in minimum spaced relationship to each other to thereby prevent the facing plate 260 and the back plate 266 from squeezing the sealing disc 272 beyond a predefined amount. It will be appreciated of course that if the sealing disc 272 is squeezed between the facing plate 260 and the back plate 266 too tightly the seal disc 272 may be damaged as the locking means 206 is pivoted.

When the facing plate 260, the back plate 266 and the sealing disc 272 are assembled into the sandwich configuration with the shaft 208 extending through the shaft receiving furrows 264 and 270, the elliptical sealing disc 272 is positioned with its major axis perpendicular to the central axis of the shaft 208. In addition, the minor axis of the sealing disc 272 will be somewhat larger than the diameter of the housing passageway 207. When the resilient seal is sandwiched between the facing plate 260 and the back plate 266, the resilient seal will be pressed upwardly by the shaft 208 into the furrow 264 with the edge of the resilient seal 272 extending outward beyond the peripheral edges 292 and 294 of the facing plate 260 and the back plate 266. Thus, as shown in FIG. 6, the peripheral edge of the seal 296 will press against the inside surface of housing 298 thereby sealing the gap between the edges 292 and 294 of the facing plate 260 and back plate 266 and the inside surface 298 of the housing 200. It will be appreciated that the inside surface 298 is preferably milled adjacent the region of contact by the edge of the seal 296 and hence there will be an annular frusto-conical section 299 connecting the milled and unmilled regions of the inside surface 298.

In the preferred embodiment, a means is provided for making the sandwich combination of the facing plate 260 the sealing disc 272 and the back plate 266 immovable relative to the shaft 208. This may be accomplished in one embodiment by providing a flat keyed region 288 on the shaft along the region where the closure means 210 is to be attached thereto and also providing a matched flat keyed region 290 along the length of the furrow 270 in the back plate 266. The closure means 210 will thus clamp onto the shaft 208 in fixed immovable relationship thereto.

It will, of course, be apparent that the reason why the resilient seal disc 272 is preferably elliptical is because in the embodiment described in FIG. 7 the resilient seal member 272 curves upwardly to enable it to pass over the shaft 208 between the shaft and the facing plate 260. This of course requires an additional length of the sealing disc perpendicular to the shaft axis to assure that the width of the edge of the sealing disc extending beyond the edges 292 and 294 is substantially constant about the entire periphery of the closure means 210.

Finally, in the preferred embodiment, the sandwiched configuration of the closure means 210 is coupled and held together by a plurality of round head bolts 280 each with a upper, square cross-sectioned, shank portion 282 which fits through the square bolt holes 262 in a rotatably immovable fashion. The threaded end of the bolt 280 then extends through the bolt holes 274 and the bolt holes 268 with appropriate clamping pressure applied by nuts 286.

While the above embodiment of the invention has been described in conjunction with a circular cross-sectioned housing it will be appreciated that any shape cross-section is possible although the shape of the closure means must be suitably configured to effect obstruction of the passageway through the housing in accordance with the invention to prevent either a foreign object or a foreign substance such as a fluid from entering the storage tank.

While the present invention has been particularly shown and described with reference to the preferred embodiments, it will be understood by those skilled in the art that the foregoing and other changes in form and detail may be made without departing from the spirit of the invention.

What is claimed is:

1. A lock apparatus for attachment to a pipe, defining a pipe passageway, communicating with a storage tank for preventing passage of a foreign object or substance into the storage tank through the pipe passageway, the lock apparatus comprising:

a housing having a housing passageway therethrough for attachment to the pipe with the housing passageway in coaxial alignment with the pipe passageway, the housing having a transverse orifice therethrough;

a valve assembly pivotally mounted in the housing for selectively obstructing the housing passageway comprising:

a shaft pivotally mounted in the housing in transverse relationship to the housing passageway with one end of the shaft extending through the transverse orifice of the housing, closure means fixed to the shaft in the housing passageway for being pivoted by the shaft, the closure means having a circumferential edge spaced from the housing, and seal means attached to extend from the circumferential edge of the closure means for contacting and sealing the space between the housing and the circumferential edge of the closure means when the valve assembly is pivoted to obstruct the housing passageway;

a latch member pivotally attached to the one end of the shaft;

a lock flange fixed to the housing externally of the housing passageway and adjacent the transverse orifice for selectively engaging the latch member and interconnecting the latch member to the lock flange; and a tamper prevention flange fixed to the external surface of the housing in linear alignment with the transverse orifice and the lock flange.

2. The lock apparatus of claim 1 wherein the latch member comprises:

a shaft engaging end;

a lock flange engagement end; and a handle flange extending from the lock flange engagement end.

3. The lock apparatus of claim 2 wherein the handle flange of the latch member has a tool engaging orifice therethrough.

4. The lock apparatus of claim 1 wherein the tamper prevention flange comprises a generally U-shaped member positioned adjacent three sides of the transverse orifice for preventing access to the one end of the shaft on three sides thereof.

5. The lock apparatus of claims 1 or 4 further comprising a positioning flange fixed to the housing, the latch member being pivotal into a position with the positioning flange extending through a latch orifice for coupling the latch member to the positioning flange, the positioning flange being attached at a location for maintaining the valve assembly in an open non-obstructing position when the latch member is coupled to the positioning flange.

6. A lock apparatus for attachment to a pipe defining a pipe passageway communicating with a storage tank, for preventing the insertion of a foreign object or substance into the storage tank through the pipe passageway, the lock apparatus comprising:

a housing having a passageway therethrough for attachment to the pipe with the housing passageway in coaxial alignment with the pipe passageway, the housing having a transverse orifice therethrough;

a valve assembly pivotally mounted in the housing for being selectively pivoted between an obstructing position and a non-obstructing position in the housing passageway comprising:

a shaft pivotally mounted to the housing in transverse relationship to the housing passageway with one end of the shaft extending through the transverse orifice of the housing;

a first rigid plate having a circumferential edge spaced from the housing;

a second rigid plate having a circumferential edge spaced from the housing;

a generally flat member sandwiched between the first and second rigid plates and extending beyond the circumferential edges of the first and second rigid plates for contacting and sealing the space between the housing and the circumferential edge of the first and second rigid plates, and means for attaching the sandwiched first rigid plate, second rigid plate and resilient member to the shaft in the housing passageway; and locking means for releasably coupling the one end of the shaft to the housing for selectively positioning and holding the valve assembly at least in the obstructing position, the locking means comprising:

a latch member pivotally attached to the one end of the shaft;

a lock flange fixed to the housing externally of the housing passageway and adjacent to the transverse orifice for selectively engaging the latch member and interconnecting the latch member to the lock flange; and a tamper prevention flange fixed to the housing external to the housing passageway in linear alignment with the transverse orifice and the lock flange.

7. The lock apparatus of claim 6 further comprising a positioning flange fixed to the housing, the latch member being pivotal into a position with the positioning flange extending through a latch orifice for coupling the latch member to the positioning flange, the positioning flange being attached at a location for maintaining the valve assembly in an open non-obstructing position when the latch member is coupled to the positioning flange.

8. The lock apparatus of claim 6 wherein the latch member comprises:

a shaft engaging end;

a lock flange engagement end; and a handle flange extending from the lock flange engagement end.

9. The lock apparatus of claim 8 wherein the shaft engaging end further comprises a shroud for covering the one end of the shaft on three sides thereof.

10. The lock apparatus of claim 8 wherein the handle flange of the latch member has a tool engaging orifice therethrough.

11. The lock apparatus of claim 6 wherein the tamper prevention flange comprises a generally U-shaped member positioned adjacent three sides of the transverse orifice for preventing access to the one end of the shaft on three sides thereof.

12. The lock apparatus of claims 1 or 6 further comprising an enclosure means about the housing and spaced therefrom for defining a chamber in which the housing is centrally positioned, the enclosure means having an access opening on one side thereof for accessing the latch member, the enclosure means being spaced from the latch member a sufficient distance to allow the latch member to be operated to pivot the valve assembly.

* * * * *